US005920922A

United States Patent [19]

Ragsdale et al.

[11] Patent Number: 5,920,922

[45] Date of Patent: Jul. 13, 1999

[54] COVER SYSTEM WITH EDGE STOPS

[75] Inventors: Kelly Ragsdale; J. Richard Clark, both of Salt Lake City; Cory Brady, South Jordan, all of Utah

[73] Assignee: Cover-Pools, Inc., Salt Lake City, Utah

[21] Appl. No.: 09/136,183

[22] Filed: Aug. 19, 1998

Related U.S. Application Data

[63] Continuation-in-part of application No. 08/932,556, Sep. 19, 1997.

[51] Int. Cl.[6] ..... E04H 4/00

[52] U.S. Cl. ..... 4/502; 4/498; 4/500

[58] Field of Search ..... 4/502, 496, 498, 4/499, 500, 503; 242/919, 419

[56] References Cited

U.S. PATENT DOCUMENTS

| | | | |
|---|---|---|---|
| D. 193,055 | 6/1962 | Lamb . | |
| D. 296,444 | 6/1988 | Lamb . | |
| 3,050,743 | 8/1962 | Lamb . | |
| 3,051,232 | 8/1962 | Lamb . | |
| 3,060,455 | 10/1962 | Lamb . | |
| 3,076,975 | 2/1963 | Lamb . | |
| 3,273,171 | 9/1966 | Lamb . | |
| 3,979,782 | 9/1976 | Lamb . | |
| 4,001,900 | 1/1977 | Lamb . | |
| 4,060,860 | 12/1977 | Lamb . | |
| 4,464,801 | 8/1984 | Lamb . | |
| 4,466,143 | 8/1984 | Lamb . | |
| 4,466,144 | 8/1984 | Lamb . | |
| 4,858,253 | 8/1989 | Lamb | 4/502 |
| 4,939,798 | 7/1990 | Last | 4/502 |
| 5,044,022 | 9/1991 | Hess | 4/502 |
| 5,105,481 | 4/1992 | Lamb | 4/502 |
| 5,184,356 | 2/1993 | Löf et al. . | |
| 5,184,357 | 2/1993 | Last . | |

OTHER PUBLICATIONS

"Automatic Pool Cover," *Save–T Cover II Catalog,* published Aug. 1986, Salt Lake City, Utah.

Joe Rolando, "Founder's Persistence Kept Cover Pools Afloat," *The Salt Lake Tribune,* Oct. 5, 1986, pp. F1–F2, Salt Lake City, Utah.

*Primary Examiner*—David J. Walczak
*Attorney, Agent, or Firm*—Trask, Britt & Rossa

[57] ABSTRACT

A system for deploying and recovering a cover over a space like a swimming pool having a reel housing that has extensions and a base that may be used to securely mount the reel housing in a receptacle like a recess box. The extensions and the base may brace the reel housing which is made of inelastic or non-deformable material which may be thick metal. The ropes are shortened in length so that there is no excess when the cover is in its fully open position. The ropes are selected to be inelastically deformable. A motor drives the rope reels in the reel housing and the drum for the cover. The clutch that engages either the rope reels or the drum has a non-sacrificial pin to ensure that the clutch and the reels or the drum remain driven and engaged. The cover has outside edges that slide in tracks secured along the edge of the space to be covered. Stop blocks are secured to the outside edge so that the edge is in tension when the cover is positioned over the space to be covered.

15 Claims, 9 Drawing Sheets

COVER SYSTEM WITH EDGE STOPS

This application is a continuation-in-part of application Ser. No. 08/932,556, filed Sep. 19, 1997.

BACKGROUND OF THE INVENTION

1. Field of the Invention

This invention relates to systems for positioning a cover over a space and more particularly to systems for positioning a cover over a swimming pool.

2. State of the Art

Swimming pools are often covered when not in use for reasons which include restricting access, limiting evaporation of water and chemicals, retaining heat and acting as a barrier to leaves, twigs and similar kinds of material. Other spaces such as ponds and other kinds of pools may also be covered from time to time for similar reasons.

A wide variety of covers are available to cover such spaces. For example, covers for swimming pools include both manual covers that are manually positioned, opened and fastened, automatic covers that are operated between open and closed configurations by an electric or hydraulic motor drive mechanism, and semiautomatic mechanisms that may be automatic in one direction and manual in the other direction. U.S. Pat. No. 3,050,743 (Lamb) discloses an early automatic cover typically used with swimming pools. A more recent version of an automatic cover is disclosed in U.S. Pat. No. 4,858,253 (Lamb).

The '253 patent shows an automatic cover system with tracks along two opposite edges of the pool. The tracks guide the edges of the cover and guide the ropes which extend outwardly from the leading edge around pulleys and back to reels. A motor is connected through a clutch to drive the drum to wind the cover to the open position and to drive reels that pull in the ropes to urge the cover to the closed position. The clutch has a sacrificial pin which will break before other damage can be inflicted to the ropes or cover. The reels are positioned in a housing which has pulleys to guide the ropes from the tracks to the reels. The pulleys are positioned so that the ropes each impose a torque or twisting force which typically elastically deflects the housing during movement of the cover from the closed to the open position. That is, the housing is fabricated from plate metal that is capable of elastic deflection and is mounted so that twisting or deflection is not inhibited.

The track has a slot or groove to accept the outside edges of the cover and a separate slot or groove to guide the rope back to its respective reel. The outside edges of the cover sometimes encounter resistance as they slide in their respective grooves, both when opening and closing. That is, corrosion, dirt, dimensional variance or a host of other factors, separately or in some combination, may restrict the movement of one or the other or both outside edges of the cover in its respective slot. Thus, when closing the cover, the motor continues to drive the reels and wind the rope even if the cover is stuck. In turn, the tension in the rope increases. The rope is made of elastically deformable material such as polyester. As the force or tension increases, the rope stretches in length. That is, the rope stretches considerably and is believed to stretch about 17 percent per unit length in selected situations. As the motor driving the wheel which is winding the rope continues to operate, the force exerted by the rope on the cover in the track increases to a point where the force is sufficient to overcome the frictional increase and the cover begins to move through or past the particular location. The cover may even accelerate in speed for a short distance until the rope tension (energy stored in the rope) diminishes to a normal or typical level or magnitude.

In operation, covers have been observed moving in a jerking or intermittent fashion along one or both edges as the edge encounters different points of high friction along the length of the track. In some cases, one edge of a cover may move much farther that the other edge so that the cover may become cocked or diagonally disposed between two substantially parallel tracks and in turn jammed in place.

Due to friction in the track, the ropes for both sides in the '253 patent stretch or elongate as the cover is positioned over the pool. When the cover reaches the end of the pool or space to be covered, the motor is shut down by a switch. As the motor shuts down, the torque or force applied to the ropes by the motor ends. In turn, the energy in the rope allows some of the rope to pay back from its respective reel so that some covers have been observed "jumping back" from the edge leaving a gap between the cover and edge of the pool. Depending on the degree of friction, it can also be seen that the force exerted by the rope may be sufficient to cause a sacrificial pin in the clutch to fail to avoid tearing the cover or breaking one of the ropes.

Covers of the type illustrated and disclosed in the '253 patent also may from time to time over wind or wind up more than required and in turn cause either one or both of the cover edges to come out of the slots of their respective tracks. That is, the rope provided is usually longer than the distance from the front edge of the cover in the open position to the pulley and back to the reel because the rope is typically cut longer and also because the rope inelastically deforms or stretches and in turn gets longer after installation. Excess rope is typically wound on the reel with as many as four or five revolutions of rope being observed on the reel in some cases for new ropes and more for older ropes. Further, it has been observed that one of the two ropes for a pool cover may stretch more than the other thereby changing the radius of the rope and the number of revolutions of the rope on the reel for any given position of the cover. Thus, the ropes for the opposite sides will tend to wind and unwind at different rates even though the reels both operate at exactly the same revolutions per minute. In turn one side travels faster than the other to contribute to misalignment of one side with respect to the other side particularly after repeated use. Thus the front edge or leading edge of a cover may become cocked or misaligned to other than the normal or generally perpendicular orientation to and between the tracks. In addition a cover with one rope longer than the other can become misaligned so that one edge can pull out of a track and require servicing.

With the ropes longer than the distance from the front edge of the cover in the open position to the reel, there is excess rope on both sides that allows the cover to be over driven. Thus, the user needs to carefully re-thread the cover outside edges into their respective slots in order to avoid damage to the cover and to resume normal operation. Of course, the cover can be over driven even if the rope is sized in length to be the same as the distance from the front edge of the cover to the reel because the rope is elastically deformable. Accordingly, if the motor is not timely turned off, it can over drive the cover and cause one or both of the opposite edges of the cover to be pulled out of their respective tracks. Upon subsequent operation, there is a risk of damage to the cover and the track as well as to other components of the system.

Some covers have an automatic shut off feature. A magnet is attached to one outside edge of a cover proximate its front edge. As the cover approaches the closed position, the magnet triggers or operates a reed switch attached to the track. The reed switch sends a signal that turns off the motor to stop the cover at the closed position. If the cover has become misaligned with the edge with the magnet sticking so that its associated rope is tensioned more and elongates more, it can be seen that the edge opposite to the edge with the magnet will reach its end first. Thereafter, the motor will continue to drive the related reel and tension the rope. Alternately the side without the reed switch can stick so that the side with the reed switch continues to advance and eventually reach the position in which the reed switch operates. The motor then turns off leaving the pool cover cocked or misaligned in a less than fully closed position.

An automatic shut off feature may be provided for the open position as well. That is, the magnet may activate a reed switch at the other end of the track and turn off the motor as the cover reaches the open position. If one edge sticks and the other does not, it can be seen that one edge can pull out or the motor can turn off before the cover reaches the fully open position.

In cover systems that use a rope, it is also noted that as the cover approaches the fully closed position, the drum upon which the cover is wound when in the open position has less material on it and in many cases is therefore able to rotate more freely or easily. As the front of the cover reaches the fully closed position, the drum has nothing to resist further rotation. Thus, the cover may not be tensionally positioned in the closed position. The webbing along the outside edges in which the rope is secured may develop wrinkles particularly if the drum over rotates. The wrinkling along the outside edges may be uneven contributing to misalignment or cocking. The wrinkling may also contribute to increased wear as the webbing puckers or wrinkles along or proximate the track.

A cover system is needed that does not jam and that does not skip or jump along the track. A cover system is needed that does not jump back from the closed position and that does not disengage one or both of the edges of the cover from their respective tracks when the cover reaches the open position. A cover system is needed that does not lead to a cocked or misaligned orientation and does not require servicing to realign to keep the cover with its front edge oriented generally normal to the tracks. A cover system is needed that does not have webbing that puckers along the outside edges.

SUMMARY OF THE INVENTION

A system for extending and retrieving a cover relative to a space to be covered has a cover shaped and sized for positioning between a closed position substantially covering the space to be covered and an open position displaced from the closed position and preferably substantially removed from the space to be covered. A space to be covered is any void or volume with an exposed surface such as a swimming pool, pond or other similar void or volume with an exposed surface. The cover has a front edge and a first outside edge spaced from a second outside edge.

First track means is spaced from second track means. Both the first track means and the second track means are positioned proximate the exposed surface of the space to be covered. Both the first track means and the second track means are configured to guide their respective first and second outside edges of the cover upon movement of the cover relative to the space to be covered. Both the first track means and the second track means also have a first end and a second end spaced from the first end.

The system also includes first line means and second line means each attached to the front edge of the cover preferably proximate the first outside edge and the second outside edge respectively for tensioning and in turn urging the cover to move relative to the space to be covered. Both the first line means and the second line means are formed of a substantially inelastic material. First guide means and second guide means are positioned proximate the first track means and the second track means respectively, to receive and guide the first line means and second line means, respectively.

The system further includes a drum which has a first end and a second end. The drum is operable in a first direction to wind the cover thereupon and in a second direction to unwind the cover. Reel means are preferably positioned and configured for receiving the first line means from the first guide means and for receiving the second line means from the second guide means. The reel means is operable to tension the first line means and the second line means to tension and in turn urge the front of said cover over the space to be covered.

The system also includes drive means connectable to the first end of the drum for rotating the drum in the first direction. The drive means is also connectable to the reel means for operating the reel means to tension the first line means and the second line means. The drive means includes a reel housing positioned proximate the drum. The reel housing is configured to support the reel means. The drive means further includes coupling means for drivingly connecting the drive unit alternately and selectively to the reel means for operating the reel means and to the drum to rotate the drum in the first direction.

The system includes a first stop block secured to the first outside edge of the cover. The first stop block abuts the second end of the first track means with the cover proximate the closed position and with the front edge of the cover in tension. The system includes a first stop block secured to the first outside edge of the cover. A second stop block abuts the second end of the second track means with the cover proximate the closed position and with the front edge of the cover in tension.

The system also includes support means for connection to the second end of the drum to support the drum.

In a preferred system, the first outside edge has a length and includes a first webbing extending substantially along said length with a first distal edge oriented and configured for association with the first track means. Similarly, the second outside edge has a length and includes a second webbing extending substantially along said length with a second distal edge oriented and configured for association with the second track means.

The first line means is desirably a first rope. The first webbing also desirably has a first channel formed along said first distal edge. A bead formed from the first rope positioned within the first channel. The second line means is also desirably a second rope. The second webbing has a second channel formed along the second distal edge. A bead is formed from the second rope positioned within the second channel.

In a more preferred arrangement, the first stop block is secured about the first bead. The second stop block is preferably secured about the second bead. It is highly preferred that the first stop block have an upper portion and a lower portion for securement to each other with the first bead thereinbetween. Similarly, it is highly preferred that the second stop block have an upper portion and a lower portion for securement to each other with the second bead thereinbetween.

In a preferred embodiment, the first track means includes a first track having a bead channel formed therein. The bead channel is sized to slidably receive the first bead and a fabric guide. The fabric guide is secured to the first track means proximate the second end thereof The second track means also preferably includes a second track having a bead channel formed therein sized to slidably receive said second bead and a fabric guide. The fabric guide for the second track means is secured to the second track means proximate the second end thereof Most desirably the first line means is a non-metallic rope and even more desirably a non-metallic rope of the type that has less than about ten percent stretch upon application of a tensioning force of up to about 500 pounds. Alternately, the non-metallic rope is of the type that has less than about five percent stretch upon application of a tensioning force of up to about 500 pounds. In another most preferred alternate, the non-metallic rope is of the type that has less than about two percent stretch upon application of a tensioning force of up to about 500 pounds.

BRIEF DESCRIPTION OF THE DRAWINGS

In the drawings which illustrate what is presently regarded as a preferred mode of the invention.

DESCRIPTION OF THE ILLUSTRATED EMBODIMENT

Figure 1:
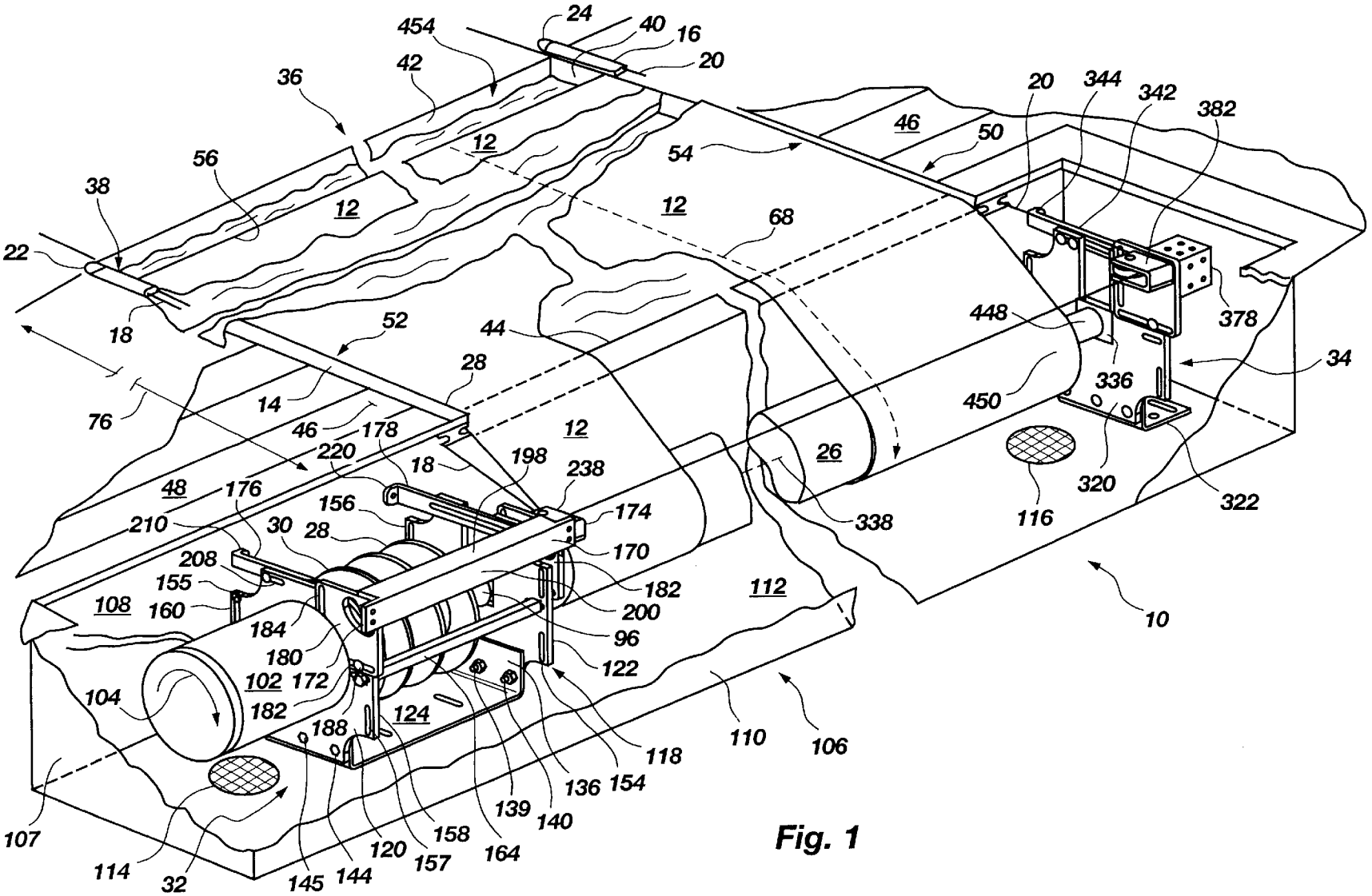
FIG. 1 is a perspective cut-away view of a system of the present invention.

A system 10 for extending and retrieving a cover generally includes a cover 12, first track 14 and second track 16, first rope 18 and second rope 20, first guide 22 and second guide 24, drum 26, first reel 28 and second reel 30, drive means 32 and support means 34. The system 10 is operable to position the cover 12 between a closed position in which the cover is positioned over a space to be covered and an open position in which the cover 12 is displaced from the closed position and preferably is positioned to substantially uncover the space to be covered. As stated hereinbefore, the space to be covered may be any void or volume having a surface that one desires to cover and uncover. As here shown, the space to be covered is a swimming pool 36. The cover 12 of FIG. 1 is shown almost, but not fully, in the closed position.

The swimming pool 36 illustrated is generally rectangular in projection with a first side wall 38, a second side wall 40 and a front wall 42. A rear wall is under the illustrated cover sill 44 and in turn is not illustrated. The swimming pool 36 has a deck or walking surface 46 that surrounds the swimming pool 36 with the first track 14 and the second track 16 shown mounted on top or on the walking surface 46 proximate the swimming pool 36. That is, the first track 14 and the second track 16 are here shown positioned close to and in alignment with the first edge 48 and the second edge 50 of the swimming pool 36. The first track 14 and the second track 16 are essentially parallel. However, it must be understood that the swimming pool 36 is only representative of virtually an infinite array of swimming pools or other voids, volumes or spaces which may be made in or come in virtually any shape or size (in projection). For example, the space to be covered includes, but is not limited to, oval pools, kidney-shaped pools, elliptical pools, oblong ponds, recessed spas, and tiered or terraced pools. With the first track 14 and the second track 16 mounted on the walking surface 46, a cover similar to cover 12 can be made to cover a wide range of shaped openings or spaces which one may wish to removably cover. The first track 14 and the second track 16 may also be mounted under a cantilevered edge or portion extending toward and into the space to be covered. In short, the space to be covered may have a lip with a first track and a second track mounted thereunder as discussed hereinafter.

The cover 12, as illustrated, has a first edge 52 and a second edge 54 that is spaced from and in general alignment with the first edge 52. The first edge 52 and the second edge 54 are shown to be parallel in the illustrated embodiment. The cover 12 also has a front edge 56 plus a rear edge that is not shown. The rear edge is mounted to and preferably attached to the drum 26. However, the rear edge is not illustrated for purposes of clarity.

The cover 12 is made from any suitable fabric including preferably a 16-ounce vinyl material reinforced with a strong polyester mesh to increase strength and tear resistance.

The first track 14 and the second track 16 are provided to act as a guide for the first edge 52 and the second edge 54 of the cover 12 and are generally parallel to each other. The track 14 is better illustrated in FIG. 2 to have a cover slot 58. The cover slot 58 receives the first edge 52 of the cover 12 to guide the first edge 52 in its travel between its open position in which it is retracted or wound upon the drum 26 and the closed position in which it is fully extended across the space to be covered. The cover slot 58 also supports the cover 12 because the first edge 52 has a bead 62 formed by folding the cover over the first rope 18 (or first line). That is, the bead 62 may be formed along the entire length 68 of the cover 12 by stitching a folded portion 64 to the cover 12 at the edge 52 along the entire length 68 (FIG. 1) of the cover 12. Additional stiffeners or gussets may be used to form the bead 62 as well to strengthen the edge 52.

The cover slot 58 is sized in cross section normal to its longitudinal axis 66 to slidingly receive the first edge 52, and more particularly the bead 62, to retain the cover 12 in a fixed position along the entire length 68 of the track 14. The track 14 may be held in place by suitable fasteners such as screws 70. Of course, expansion bolts, glue or any other kind of fastening material or device can be used as desired so long as the track 14 provides a secure mounting for the cover 12.

Figure 2:
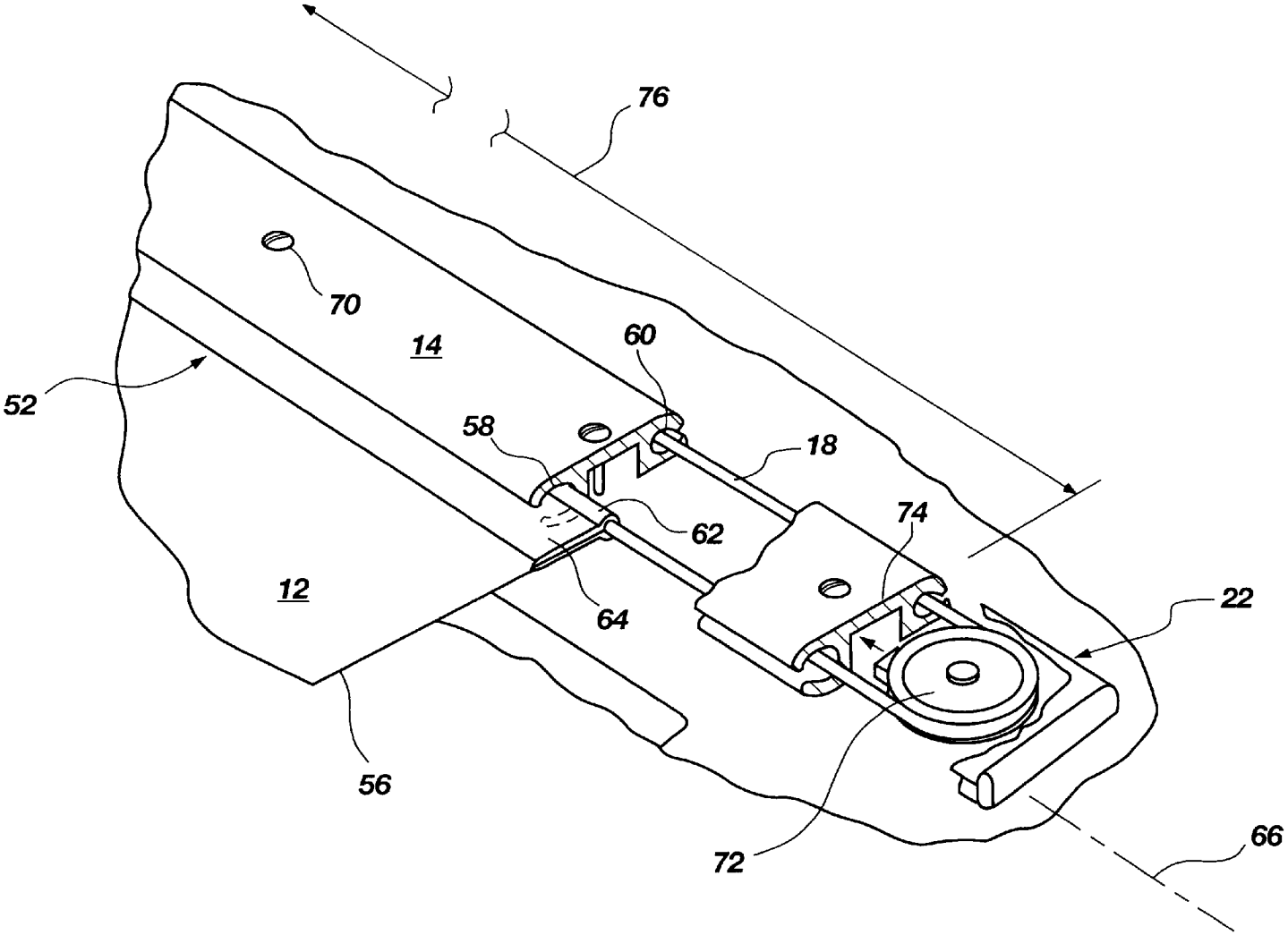
FIG. 2 is a partial cut-away perspective of portions of the track and guide means for use with a system of the present invention.
Figure 9:
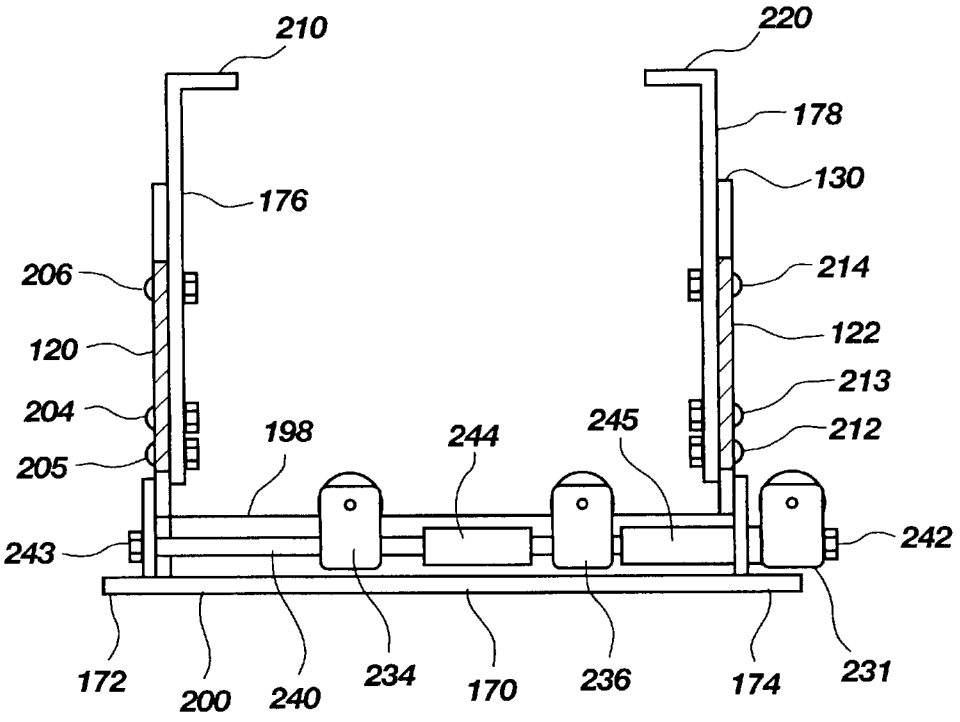
FIG. 9 is partial bottom cross sectional depiction of a reel housing with reels for use with a system of the present invention.

The first rope 18 is stitched into the edge 52 of the cover 12 and extends therefrom through the cover slot 58 to the first guide means which is shown in FIG. 2 as a pulley mechanism 72 inserted into the distal or first end 74 of the first track 14. The first rope 18 is trained around the pulley mechanism 72 and directed into the rope slot 60. The first rope 18 extends through the rope slot 60 along the length 76 of the first track 14 to the proximal or second end 78 of the first track 14. Thereafter the first rope 18 is directed through pulleys to the first reel 28, as more fully discussed hereinafter. It should be noted that a pulley 72 is here depicted is a guide means. Other forms of guide means may be used including a rounded post, a roller or other structure suitable for changing direction in a general, nondestructive manner.

Figure 3:
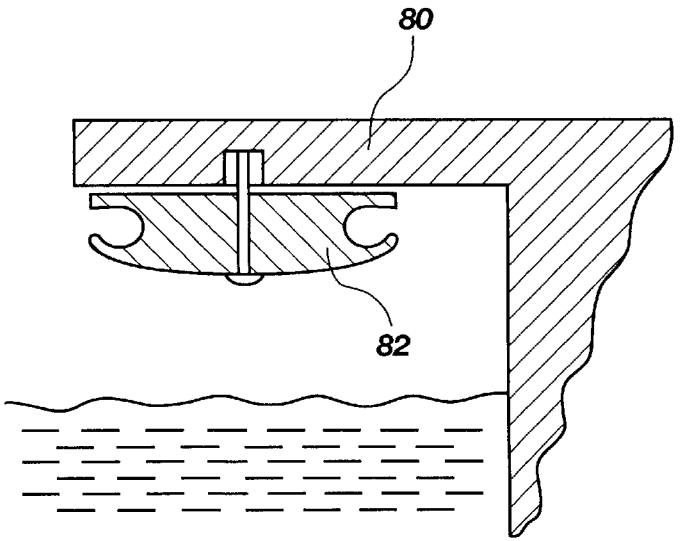
FIG. 3 is a partial cross sectional depiction of track for use with the system of the present invention.

The first track 14 and the second track 16 are both shown mounted to the walking surface 46 and in turn are exposed. For some spaces, including pools with an overhang or lip 80 (FIG. 3), the track 82 may be installed under the overhang or lip 80 to recess the track, to enhance the esthetic appearance and to remove the track 82 from underfoot.

The second track 16 with the second rope 20, the second guide 24 and the second edge 54 of the cover 12 are all configured and assembled substantially as shown and described for the first track 14, first guide 22, first rope 18 and first edge 52. The second track 16 and the second edge 54 structure are not here further described in detail for brevity because they are configured and formed virtually the same as the first track 12 and first edge 52 except for those changes necessary for placement on the opposite side.

In the prior art, ropes have been used to extend from the front edge of a cover such as front edge 56 of cover 12 so the cover may be opened by placing a tension on the ropes. Such ropes in the prior art are shown trained around a pulley or the like at the end of their tracks and returned to reels. Such ropes have been sized to be longer than double the length 76 of the track 14 plus the distance from the distal end 78 to the reel such as reel 28. With the ropes so sized, several revolutions (4 or 5 typically) of the rope are generally positioned about the hub of the reel to allow for errors in measurement and installation and to absorb the additional length. Further, the ropes of the prior art are elastic and may significantly stretch (e.g., as much as 17% of its length upon the generation of significant force such as, for example 150 lbs.). Thus one or both of the ropes stretch to avoid damaging the rope or the cover should one or both sides of the cover jam or stick in its respective track upon movement toward the closed position or toward the open position.

Figure 4:
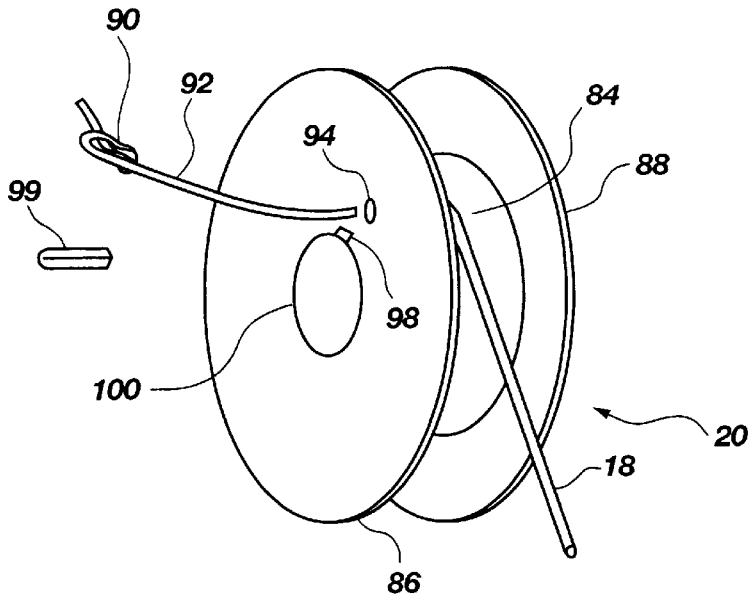
FIG. 4 is a perspective view of a reel for positioning in a reel housing for use with a system of the present invention.

In FIG. 4, a first reel 28 is shown with a hub 84 between two guides 86 and 88. The rope 18 is sized so that upon installation, the rope 18 is tight and under slight tension with the cover 12 fully retracted onto the drum 26 in its retracted or storage position. A knot 90 is formed in the end 92 of rope 18 which acts as a stop for the rope 18 to inhibit passage of the rope 18 and the knot 90 through an aperture 94 formed in the guide 86. The reel 28 is positioned on shaft 96 with the shaft 96 extending through the opening 100. The reel 28 is held by a key 99 that is positioned in slot 98 and in a slot on the shaft (not shown).

The ropes 18 and 20 are selected to not be substantially elastic. Rather, they are selected to be substantially inelastic and preferably suffer less that 10 percent elongation per unit length when under tension of up to about 500 pounds. For example, with less than 10 percent elongation, one foot of rope would extend or lengthen no more than 1.2 inches when under 500 pounds of force exerted along the length of the rope. Rope that suffers less than 5 percent elongation when under up to about 500 pounds of force exerted along its length is preferred. Rope that has less than 2 percent elongation when under up to about 500 pounds of force exerted along the length of the rope is most preferred. Thus, a rope one foot in length would suffer no more than about 0.24 inch of elongation. A preferred rope is Number 8 Solid Braid Polyester with Technora Core available from ALL LINE, Inc., 31 West 310 91$^{st}$ Street, Naperville, Ill. 60565. Thus, the ropes 18 and 20 are substantially or essentially inelastic. Tensional forces are not absorbed or stored in the tensioning and elastic lengthening or dissipated by the elastic shortening of the ropes as before. Tensional forces are promptly and directly communicated to the front edge 56 of the cover 12 and more particularly the front edge 56 proximate the tracks 14 and 16.

Returning to FIG. 1, the drum 26, as hereinbefore stated, is operated to wind the cover 12 thereupon. That is, the edge of the cover opposite the front edge 56 is positioned or secured to the drum 26. Thereafter, rotation of the drum 26 in the clockwise 104 direction by the motor 102 of the drive means 32 through rotation of shaft 96 causes the cover 12 to be wound upon the drum 26. Of course the direction of rotation of the drum may be counterclockwise in selected installations depending on the configuration. As the cover 12 is wound onto the drum, the ropes 18 and 20 are pulled from the reels 28 and 30 which ratchet about their axle. Thus, the amount of rope 18 and 10 that is payed out is based on need. Excess rope 18 and 20 is not typically built up in the rope reels. Should one edge 52 be wound faster than the other edge 54, it can be seen that as the cover 12 approaches the fully uncovered position, the edge 52 that is ahead will necessarily stop because the related rope 18 has run out and cannot stretch. The reel 28 will thereupon freewheel on about its axle. At the same time, the edge 54 that is lagging is able to continue to wind on the drum 26 because the motor 102 continues to drive the drum 26. In turn the side of the drum 26 with the lagging edge such as edge 54 will continue to take up some cover 12 leading to a straightening of the edge 56. That is, a cover 12 that becomes misaligned in use will inherently always self align because the ropes 18 and 20 cannot appreciably stretch; and the drum 26 will inherently always continue to drive the cover 12 until both ropes have reached their maximum length. In other words, the cover 12 automatically aligns itself every time it is opened.

When operating the cover 12 to the closed position, one side 52 may arrive at the closed position before the other side 54. The rope 18, being essentially inelastic, cannot drive further and in turn cannot become like a cocked spring storing energy as the motor continues to operate to drive the rope 20 for the other side 54. Rather, the rope stalls and the motor increases its slip (if electrical) dissipating the energy in the motor. Indeed, when both ropes 18 and 20 have brought the front edge 56 to the fully closed position, the motor cannot stretch the ropes 18 and 20 so that when the motor is turned off the cover will jump back or toward the open position as may occur from time to time with present systems. Rather, the ropes 18 and 20 stall the motor so that the electrical slip increases. In turn the motor must dissipate the energy by, for example generating heat.

Upon operation of the reels 28 and 30 by the motor 102, the ropes 18 and 20 are tensioned to draw the cover 12 from the drum 26. The drum 26 is then freely rotating so that the cover 12 will pay out and cover the space to be covered such as the entire pool 36. Should one edge 52 or the other edge 54 encounter increased friction or resistance to travel, the related ropes 18 and 20 do not appreciably stretch so that the cover 12 and more particularly the edges 52 and 54 remain fairly closely in line. The ropes 18 and 20 do not therefor change in length and in turn cannot easily cause the cover 12 to cock or jam in the track 14 and 16.

The drum 26 is sized in diameter of about 10 inches to 12 inches and is made from a corrosive resistant metal. However, it should be understood that virtually any convenient material can be used so long as it can be made to rotate. Although the drum 26 is shown to be cylindrical, it should be understood that the drum 26 could be rectilinear in cross section, triangular in cross section or in any suitable geometric shape. Indeed any shape will do so long as a cover such as cover 12 can be wound thereupon.

The motor 102 is here illustrated as an electrical motor. That is, an electrical motor of appropriate horsepower is selected based on the size of the cover 12. Other kinds of motors may be used including a hydraulic motor. Indeed any device that delivers sufficient rotational torque to operate the drum may be used as the motor 102.

In the prior art, the ropes connected to the front edge of the cover are elastically deformable and when under tension they in fact elongate as they store energy. Thus the ropes are under tension which increase until whatever frictional resistance is overcome. As the frictional resistance is overcome, the next portion of the track may have reduced resistance so that the cover jerks or jumps along in the track instead of operating at a relatively smooth rate as the cover moves from the open to the closed position. As the cover reaches the fully closed position, the motor must be disengaged. If the motor is not timely disengaged, it can be understood that the prior art ropes would continue to wind creating a spring or tensional force which would urge the reels to unwind upon deactivation of the motor. In turn some amount of jump back could be experienced which could in some cases creates an undesirable gap between the front edge 56 and the edge of pool.

Of course when transitioning from the closed to the open position, there is a risk that the drum 26 could overrun or not be turned off in time. If the drum 26 did not shut off correctly, one or both edges comparable to edges 52 and 54 could be pulled out of their respective track so that the front edge 56 of the cover 12 could slip out. In fact, one or more of the side edges have from time to time slipped out of their respective cover slot in their respective track such as cover slot 58 because the rope was long enough to permit the cover to do so. In turn, one would need to service the installation in order to reinsert the edge 52 or edges 52 and 54 into their respective cover slots such as cover slot 58.

The drum 26 can be seen to be positioned in a receptacle 106 which is formed in the ground or area immediately adjacent the pool 36 and more particularly one edge thereof The receptacle 106 is holding means sized and shaped to retain the drum 26 with the cover 12 thereon in the open or stored condition or position. Of course the drive mechanism 32 is also shown in the receptacle 106. The receptacle 106 is here shown as a recessed box 107 having a front 108, a rear 110 and a bottom 112. When the receptacle 106 is positioned below the walking surface 46, drains 114 and 116 are formed therein to avoid a collection of swimming pool water and rain water in the receptacle 106 which in turn could impose some damage on the drive mechanism 32.

The box 107 is holding means which may also be a bench positioned at or on the surface 46. Other structures and configurations of holding means may be used as desired.

The drive means 32 shown in FIG. 1 includes a drive unit such as the motor 102 mounted to the reel housing 118. The drive means 32 also includes a coupling means for selectively coupling or connecting the motor 102 to drive the drum 26 in one direction to wind the cover 12 into the open position and to drive or operate the reels 28 and 30 to urge the cover 12 to the closed position as more fully discussed hereinafter.

Figure 5:
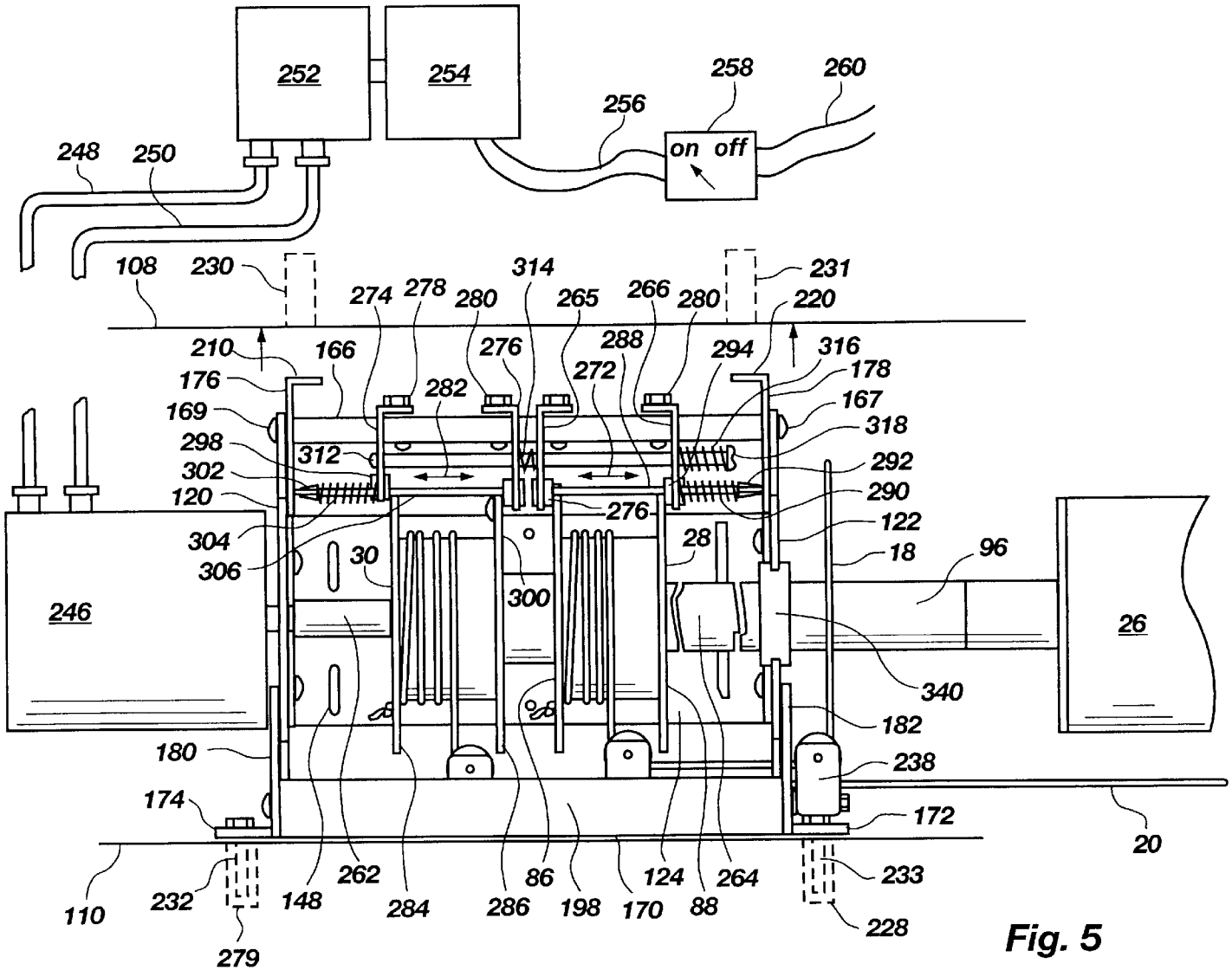
FIG. 5 is a partial top view depiction of portions of a system of the present invention in a receptacle with an alternate drive unit.
Figure 6:
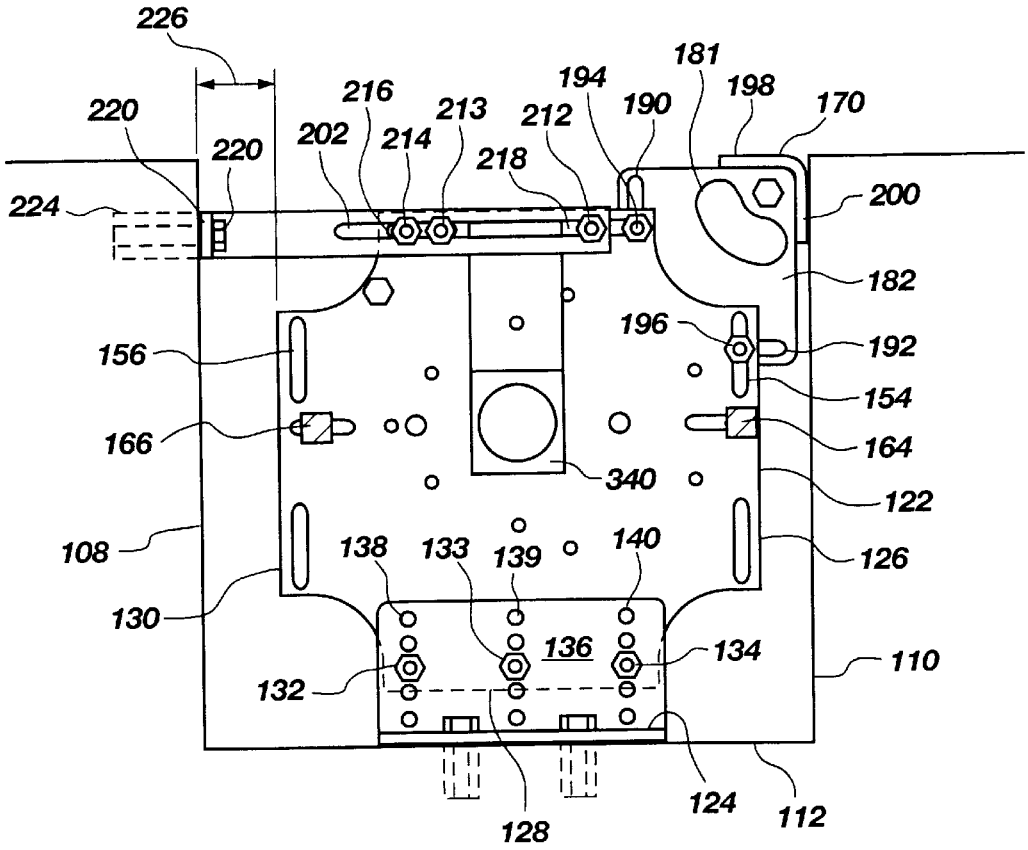
FIG. 6 is a cross sectional side depiction of portions of a reel housing for use with a system of the present invention.
Figure 7:
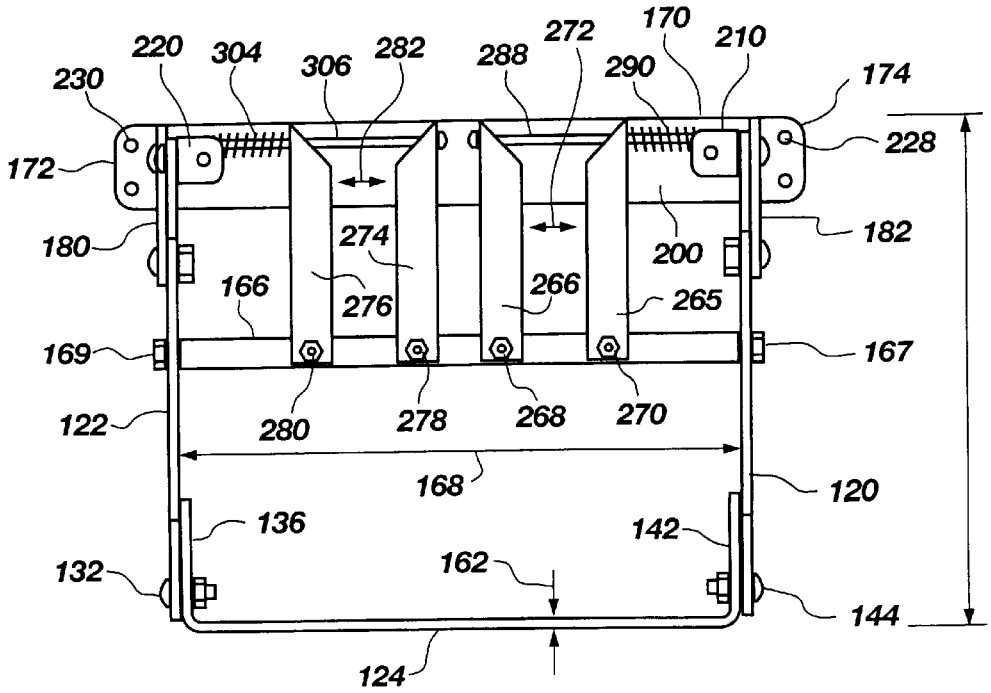
FIG. 7 is a partial front cross sectional view of a reel housing for use with a system of the present invention.
Figure 8:
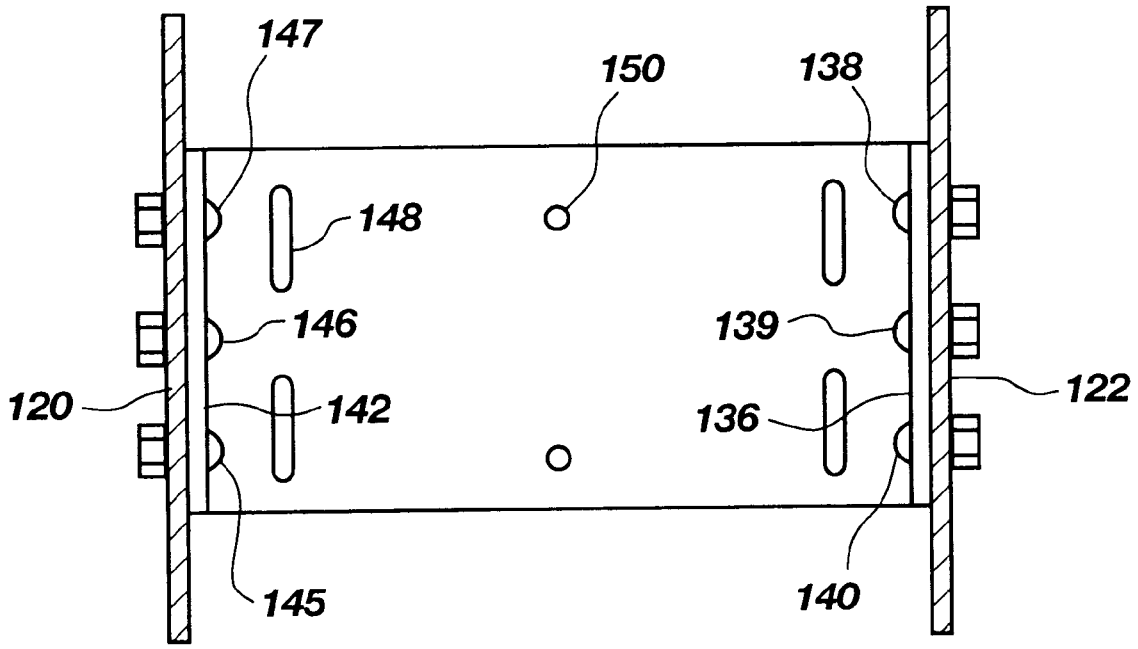
FIG. 8 is a partial top cross sectional view of a reel housing for use with a system of the present invention.

Referring to FIG. 1 and FIGS. 5–9, the reel housing 118 can be seen to include a first side 120, a second side 122 and a base 124. The base 124 functions as a second fastening or connecting means for securing the reel housing 118 in addition to first fastening or connecting means discussed hereinafter. The first side 120 and the second side 122 are both plates similar in shape and dimension. As better seen with reference to the second side 122, the second side 122 as well as side 120 is formed with a front 126 oriented toward the front 110 of the receptacle and more specifically the recessed box 107. The second side 122 also has a bottom 128 and a rear 130 each respectively oriented toward the bottom 112 and the rear 110 of the recessed box 107. Apertures are formed proximate the bottom 128 of the second side 122 sized to receive bolts 132, 133 and 134 there through for fastening the base 124 to the second side 122. As can be seen in FIG. 6, the base 124 has a flange 136 that extends away therefrom. The flange 136 has a plurality of holes in rows 138, 139 and 140 so that the flange 136 and in turn the base 124 may be positioned in different locations relative to the second side member 122. The base 124 has another flange 142 formed with rows of holes similar to that of flange 136 so that it may be at different locations to the first side 120 by bolts such as bolts 144, 145 and 146. The flange 124 has a pattern of slots 148 and apertures 150 through which fasteners may be positioned to secure the flange 124 to a support surface such as the bottom 112, the front 108 and the rear 110 of the recessed box 107. Thus the base 124 may be attached to and between the first side 120 and the second side 122 to vary the height 152 in order to position the reel housing 118 at a desired location in the recessed box 107.

Notably, the first side 120 and the second side 122 of the reel housing 118 each are formed to have slot structure such as slot structure 154 and 156 proximate the front 126 and rear 130 of the second side 122 and slot structure 155 and 157 proximate the front 158 and the rear 160 of the first side 120. Thus, the base 124 may be positioned against and secured to the front 108 or the rear 110 of the recessed box 107 by moving the base 124 to be fastened through the slots 154–157 to the first side 120 and the second side 122 using some of the bolts 138, 139, 140, 144, 145 and 146 along with their respective nuts. Therefore, during installation, the reel housing 118 may be positioned with greater precision and in any one of several locations as desired. For swimming pools, the recessed box is typically formed by a contractor building the pool. The recessed box 107 in some cases does not meet desired specifications and can be bigger, wider, deeper or of uneven dimension. The reel housing 118 may thus be more easily positioned accurately and without being impacted by the dimensional variances of the holding means such as recessed box 107.

Reel housings in the prior art have typically been made of materials that permit substantial flexing during operation. That is, it can be seen that a rope imposes a force on the housing through its associated reel if and when a cover is sticking in one or both tracks. Since the rope is displaced away from the axis of the shaft upon which the reel is mounted and because the rope is not centrally disposed in its reel housing, a twisting force or torque is applied to the reel housing which in turn has flexed and twisted the reel housing within its holding means or receptacle. Given the elasticity of the prior art ropes and the availability of a sacrificial pin as herein discussed, the twisting or flexing of the reel housing has been acceptable.

The reel housing 118 and more particularly the first side 120, the second side 122 the base 124 and other components as hereinafter discussed are made of materials selected to inhibit and minimize flexing or twisting. For example, the first side 120 and the second side 122 as well as the base 124 and flanges 142 and 136 are made of a substantially inelastic material. Preferred materials include metal alloys including aluminum plate that is from about one-eighth of an inch to about one-fourth of an inch thick 162 and preferably about three-sixteenths of an inch thick. Such materials resist the twisting and flexing with the forces that are typically exerted by the ropes 18 and 20 during operation of the cover 12.

To further strengthen the reel housing 118 and limit twisting or flexing, a front stiffener 164 and a rear stiffener 166 are secured by bolts, such as bolts 167 and 169, between the first side 120 and the second side 122. The front stiffener 164 and rear stiffener 166 are sized to be substantially the same in length 168 and function to inhibit twisting of the sides 120 and 122 relative to each other.

The reel housing 118 also has first connecting or fastening means for connecting the reel housing 118 to the holding means such as a receptacle and more specifically recess box 107. The first connecting or fastening means is provided to connect the reel housing 118 between and to the front 108 and the rear 110 of the receptacle such as recessed box 107. When in place, the first connecting or fastening means connects to not only fasten or connect but also to stiffen the reel housing 118 to reduce flexing and twisting upon application of forces by the ropes 18 and 20 during operation. The first connecting means includes a first cross bracket 170 with ears 172 and 174 along with a first extension 176 and a second extension 178.

The cross bracket 170 has a first side plate 180 and a second side plate 182 attached such as by welding or some other acceptable fastening arrangement to extend generally perpendicular thereto along the outside surfaces of the first side 120 and the second side 122. The first side plate 180 has slots 184 and 186 through which bolts such as bolt 188 are positioned to adjust the first side plate 180 to the first side 120. The second side plate 182 also has slots 190 and 192 to receive bolts 194 and 196 to secure the second side plate 182 to the second side 122. The cross bracket 170 has a first side 198 and a second side 200 generally normal to the first side 120 to provide for increased rigidity and strength. In turn flexing and twisting of the reel housing 118 is limited when the cross bracket 170 is installed. It may also be noted that the first side plate 180 and second side plate 182 each have a comma or peanut shaped aperture 181 to receive ropes 18 and 20 there through for further association with pulleys as hereinafter discussed.

The first extension 176 and the second extension 178 are each metal bars that have slots such as slot 202 formed in the second extension 178. The slots such as slot 202 facilitate movement of the first extension 176 and the second extension 178 to contact the rear 110 of the recess box 107 or similar receptacle in order stiffen and secure the reel housing 118 in place. That is, the first extension 176 is secured to the first side 120 by bolts 204, 205 and 206 with their associated nuts positioned through a slot formed in the first extension 176 comparable to the slot 202 and through slots such as slot 208 formed in the first side 120. The first extension 176 has a tab 210 with an aperture 211 to receive a fastener to secure the first extension 176 to the rear 110 or comparable surface of a receptacle.

The second extension 178 is secured to the second side 122 by bolts 212, 213 and 214 with their associated nuts through slots 216 and 218. The second extension 178 also has a tab 220 with an aperture to receive bolt 222 there through. As can be seen in FIG. 6, the bolt 222 is secured into a masonry foundation with a screw anchor 224. Alternately a compression bolt or other fastening arrangement may be used to secure the second extension 178 to the rear 110. As also seen in FIG. 6, the second extension 178 is extended a distance 226 from the back 130 of the second side 122 in order to secure the reel housing 118 in the receptacle such as recess box 107. That is, bolts or screws are positioned through apertures 228 and 230 in the ears 174 and 172 respectively as well as through the apertures 211 and 221 in the tabs 210 and 220 respectively. In turn the reel housing 118 is secured at its four corners to resist twisting and flexing motion. That is, apertures 228 and 229 may be formed in the front 108 and apertures 230 and 231 may be formed in the rear 110. The bolts or screws such as bolts 232 and 233 may be connected using screw anchors or other means for connecting based on the surface that is presented for a particular installation.

The reel housing 118 also has pulleys 234, 236 and 238 mounted to a pulley axle 240 that is connected to the first side 120 and the second side 122 by bolts 242 and 243. The pulleys 236 and 238 are sized and positioned to receive and direct the first line means such as first rope 18 to the first reel 28. Pulley 234 is positioned to direct the second line means such as second rope 20 to the second reel 30. The position of the pulleys 234 and 236 is maintained on the axle 240 by spacers 244 and 245.

Referring to FIG. 5, an alternate drive unit is illustrated supported by the reel housing 118. More specifically, a hydraulic motor 246 is shown connected by a hydraulic supply line 248 and a hydraulic return line 250 to a supply 252 of hydraulic fluid under pressure. The supply 252 may be a pump driven by an electrical motor 256 which is controlled via wires 256 by a controller 258 that is conductively connected by wires 260 to an external source of power.

FIG. 5 also shows the first reel 28 and the second reel 30 positioned on shaft 96. Coupling 262 and dog clutch 264 drivingly engage to drive either the reels 28 and 30 or the drum 26 through shaft 96. The dog clutch 264 operates as illustrated and described in U.S. Pat. No. 4,858,253 (Lamb) which issued on Aug. 22, 1989 the disclosure of which is hereby incorporated by this reference.

The first reel 28 and the second reel 30 each ratchet around the coupling 262 when the motor 246 is drivingly engaging with the shaft 96 to drive the drum 26 to wind the cover 12 onto the drum. The first rope 18 and the second rope 20 on the first reel 28 and second reel 30 pay out. If the first rope 18 or the second rope 20 becomes loose on their respective first reel 28 and second reel 30 or if the first reel 28 and/or the second reel 30 spin faster than desired, excess rope begins to loosen and may foul the reel housing. The front stiffener 164 and the rear stiffener 166 act to retain the first rope 18 and the second rope 20 on their respective first reel 28 and second reel 30.

To regulate the rotation of the first reel 28 and the second reel 30 a micro braking system is provided. More specifically the micro brake system has a pair of levers 265 and 266 rotatably mounted to the rear stiffener 166 by bolts 268 and 270 so that the levers 265 and 266 may move toward and away 272 from the hub guides 86 and 88 of the first reel 28. The micro brake system also has a pair of levers 274 and 276 that are rotatably mounted to the rear stiffener 166 by bolts 278 and 280. Thus the levers 274 and 276 may move toward and away from the hub guides 284 and 286 of the second reel 30. A bolt 288 extends between the levers 265 and 266. A spring 290 is held on the bolt 288 by wing nut 292. Operation of the wing nut 292 causes the levers 265 and 266 to press nylon wear bushings 294 and 296 against the hub guides 86 and 88 to regulate the speed of the first reel 28. Similarly the levers 274 and 276 have wear bushings 298 and 300 which press against the reel guides 284 and 286 upon operation of the nut 302 to compress spring 304 on bolt 306.

FIG. 5 also illustrates an optional second or macro brake system having a long bolt 312 which is interconnected to all four levers 265, 266, 274 and 276 with a first spring 314 and a second spring 316 compressed by nut 318. Speed adjustment by use of the macro brake system separately or in combination with the micro brake system can be effected to regulate the speed of the rope reels 28 and 30 in both the winding and unwinding of rope. Braking the first reel 28 and the second reel 30 in the cover-wind configuration may also be desired in order to keep the cover 12 straight and to pull the cover 12 so that it winds on the drum 26 under tension and is therefore more tightly wound and is wound straighter than when no tension is applied to the first rope 18 and the second rope 20.

Turning now to FIGS. 10–13, a support means 34 for use with the invention is illustrated. The support means 34 functions to support one end of the drum 26 and also to guide the second line means or second rope 20 from the track such as second track 16 to the second reel 30. The support means as illustrated has a support plate 320 which is identical to the second side 122 of the reel housing 118. Therefor the manufacture may realize certain economies in manufacture and assembly of systems.

The support plate 320 has a base 322 attached thereto with bolts 324, 325 and 326 to act as second securing means. The base 322 has a flange 328 formed therewith at one end with rows 330, 331 and 332 of a plurality of apertures. The height 334 of the support means may be adjusted by selecting different apertures in the rows 330–332 to receive the bolts 324–326. In turn, the height of the pillow block 336 may be selected so that the drum 26 is maintained with its axis 338 (FIG. 1) essentially horizontal or level to minimize wear of the pillow blocks 336 and 340 (FIG. 6) which support the drum 26. The pillow blocks 336 and 340 also act as wear bushings or bearings for the drum 26.

The support plate 328 also has first securing means which includes an extension 342. The extension 342 is identical to the second extension 178 of the reel housing 118. The extension 342 has a tab 344 which has an aperture to receive a screw or bolt to secure the tab 344 and in turn the extension 342 and the support means 34 to a surface of the receptacle such as the rear 110 of the recess box 107. The extension 342 has an elongated slot 346 to receive bolts 348, 349 and 350 so that the extension 342 may be adjusted to extend away 352 from the support plate 328 any desired distance to effect contact of the tab 344 with the surface of the receptacle.

The support plate 328 has slot structure 354 and 356 to receive the bolts 348–350 to secure the extension 342 to the support plate 328. Slot structure 358, 359, 360 and 361 is also provided at the front 362 and the back 364 of the support plate 328 to receive the base 322 so that the support means 34 may be secured in the holding means and more particularly in its receptacle in a variety of configurations to accommodate receptacles of different configurations, dimensions and tolerances.

A cross member 366 is also secured to the support plate 328. The cross member 366 has a side plate 368 which has slots 370 and 372 that receive bolts 374 and 375 to fasten the cross member 368 to the support plate 328. The cross member 366 has a first side 376 and a second side 378 which are either unitarily formed or welded together with a plurality of apertures 380 formed in both sides 376 and 378 to receive screws or bolts for fastening to a surface of the receptacle such as front surface 108 of recess box 107. A separate pulley 382 is mounted to a pulley shaft 384. The pulley shaft 384 is mounted to the support plate 320 by bolt 386. The pulley shaft may have an "L" tab 388 which has an aperture 390 sized to receive a screw or bolt to fasten the "L" tab to a surface such as the front 108 of the recess box 107. In use, the "L" tab and the support plate 320 provide a stable base for the pulley 382 to tensionally receive the second rope 20 there around.

The support plate 320 as well as the base 322, the flange 328, the extension 342 and the cross member 366 are all made of a metal selected to be substantially inelastic to reduce the deflection that may be present when forces are applied by the opening of the cover. Preferably the metal is an aluminum alloy that is from about one-fourth of an inch to about one-eighth of an inch thick 392 to reduce the deflection and displacement that may arise during use to a nominal amount. For example, the deflection between sides 120 and 122 as determined by movement of the sides relative to each other so that the distance between the sides 120 and 122 will vary along the length or height of the sides 120 and 122 may vary less than about one-fourth of an inch and preferably less than about one-eighth of an inch.

Figure 14:
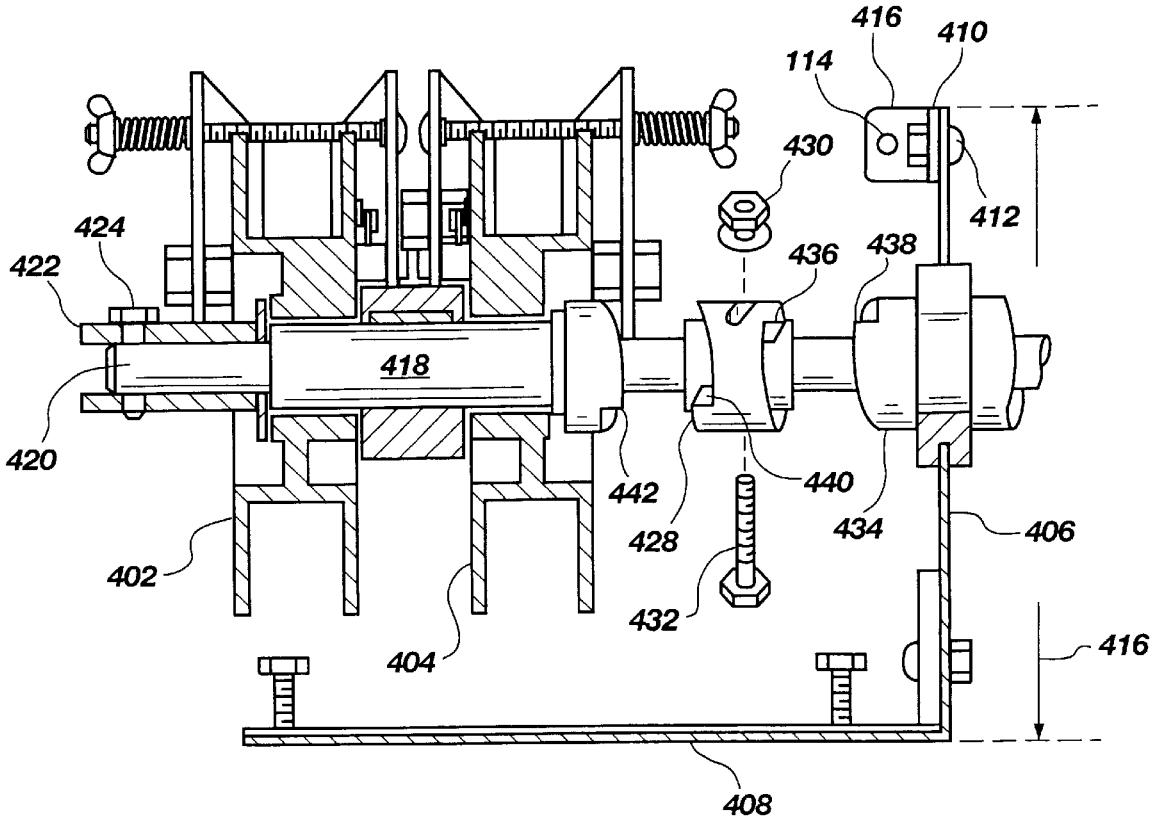
FIG. 14 is a rear view of a partial cross section of a reel housing for use with a system of the present invention.

Referring now to FIG. 14, a partial cross sectional view of a reel housing 400 has a first reel 402 and a second reel 404. The reel housing has a side 406, a base 408 and an extension 410. The extension 410 is bolted to the side 406 by bolts such as bolt 412. The extension 410 is comparable to extensions 176 and 178 so that it is adjustable for contact with a surface of a receptacle. In turn, the extension 410 may be secured to the surface of the receptacle by a screw or bolt positioned through aperture 414 in tab 416. The reel housing 400 has another side and extension not here shown.

The base 408 of the reel housing 400 extends between side 406 and another side not shown. The base 408 is adjustably secured to the side 406 and the other side not shown by bolts positioned through apertures of an array of apertures provided to permit adjustment in height 416 relative to the side 406.

The first reel 402 and the second reel 404 are each mounted to a common shaft 418 which is free to rotate about the connecting shaft 420. The connecting shaft 420 is driven by a motor (not shown) through a sleeve shaft 422 that is secured by bolt 424 to the connecting shaft 420. The connecting shaft 420 extends through the common shaft 420 and into a drum shaft 426. The connecting shaft 420 has a dog clutch 428 secured thereto by a nut 430 and bolt 432. The bolt 432 is not a sacrificial pin. That is, in prior art arrangements a weak or breakable pin is used to connect a dog clutch to a driving shaft. Although the bolt 432 may break under certain circumstances, it is selected to be strong enough to not break in use. That is, it is selected to be considerably stronger that the prior art sacrificial pin and in turn is in effect a non sacrificial pin that should withstand the forces attributed to a jammed or stuck cover which causes the drive unit to stall.

The dog clutch 428 is shown spaced from face member 434. In practice they are quite close so that when the connecting shaft 420 rotates in one direction, the clutch lip 436 engages the face member lip 438 to in turn rotate the drum such as drum 26. When the connecting shaft 420 rotates in the other direction, the dog clutch has a second lip 440 that engages the lip 442 of the shaft 418 to in turn rotate the reels 402 and 404 that are keyed to the shaft 418. FIG. 14 also shows the wear bushings 444 and 446 comparable to wear bushings 294, 296, 298 and 300 in FIG. 5.

Figure 10:
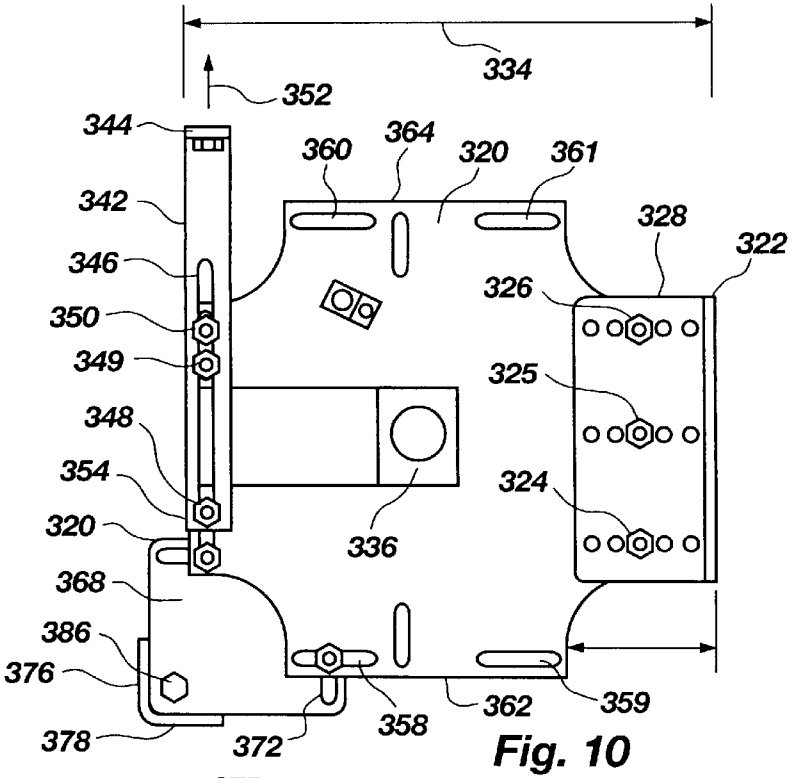
FIG. 10 is a side view depiction of a support member for use with a system of the present invention.
Figure 13:
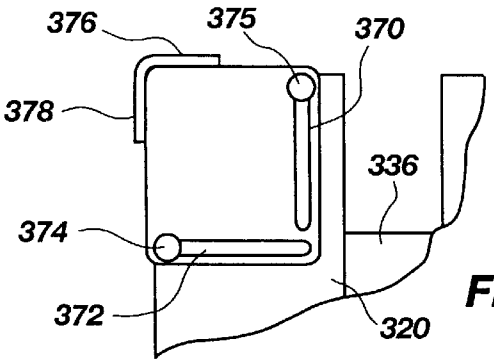
FIG. 13 is a partial side view of a cross member of a reel housing for use with a system of the present invention.
Figure 11:
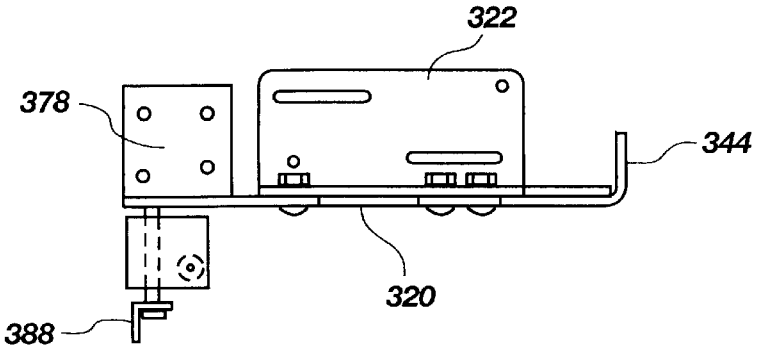
FIG. 11 is a top view depiction of a support member for use with a system of the present invention.
Figure 12:
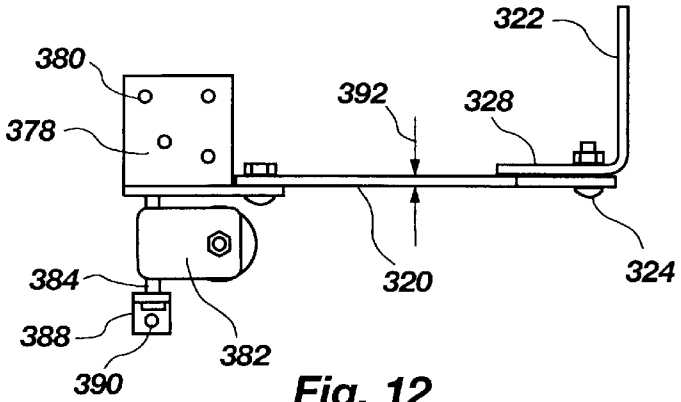
FIG. 12 is a bottom view depiction of a support member for use with a system of the present invention.

It should be noted that the drum 26 (FIGS. 1 and 5) is rotated upon operation of a drive unit and a connector such as the dog clutch shown in FIG. 14. The shaft 96 attached to drum 26 is supported by a pillow block such as pillow block 340 (FIG. 5). The drum 26 has a similar shaft 448 at its other end 450 which extends to the support means 34 and is support by pillow block 336 (FIG. 10). The motor, such as motor 102 or motor 246, is supported by the reel housing such as reel housing 118, by a bearing or bushing positioned in the first side member, such as first side member 120.

In operation, the system 10 applies a pulling force through the first rope 18 and the second rope 20 which is may vary based on the resistance encountered by the cover 12 as it travels from the open to the closed position. The motor is selected based on the size of the cover to be wound and unwound and is typically about one-third horse power for most small back yard pools (e.g., less than 20 feet by 30 feet in dimension) to be able to supply the necessary torque and in turn force to overcome the resistance to be encountered. Thus, the cover 12 will move out at a more constant speed or rate rather than jerking between high, low and no speeds as the resistance to movement of the bead 62 of the cover 12 in the cover slot 58 varies. In turn, the risk of wear and damage to the cover 12, the first rope 18 and the second rope 20 is reduced along with the risk of a jam in which one edge 52 of the cover 12 continues to move when the other edge 54 does not, or vice versa. Further upon reaching a fully closed position, the first rope 18 and the second rope 20 have little or no elasticity so that neither operates like a spring which will force the cover back open as the driving motor stops turning. In turn, the front edge of the cover 12 will not bounce back to create a cover gap 454 much like that illustrated in FIG. 1.

Also in operation to an open configuration, the cover 12 is held at its front edge 56 by the first rope 18 and the second rope 20 to tension the cover 12 as it rolls onto the drum 56. In effect the cover 12 is more tightly wound on the drum 26 reducing the risk of a loose wind and contact with one or more sides of a holding means such as a receptacle. Further, as the cover 12 reaches the filly open position, portions of the edges 52 and 54 near the front edge 56 are still in their respective cover slots such as cover slot 58. The first rope 18 and the second rope 20 are sized in length to have fully unwound from the hubs of their respective reels 28 and 30 so that in effect the first rope 18 and the second rope 20 go taut with no more length left to pay out when the cover 12 attains the fully open position. Since the first rope 18 and the second rope 20 are essentially inelastic, the cover stops and the edges 52 and 54 do not and cannot disengage from their respective cover slots. In turn, the motor cannot overdrive the cover 12 or one of its side edges beyond the open position or cause the ropes 18 and 20 to over pull and allow for some recoil to create a cover gap 454 with all its concomitant hazards.

Figure 15:
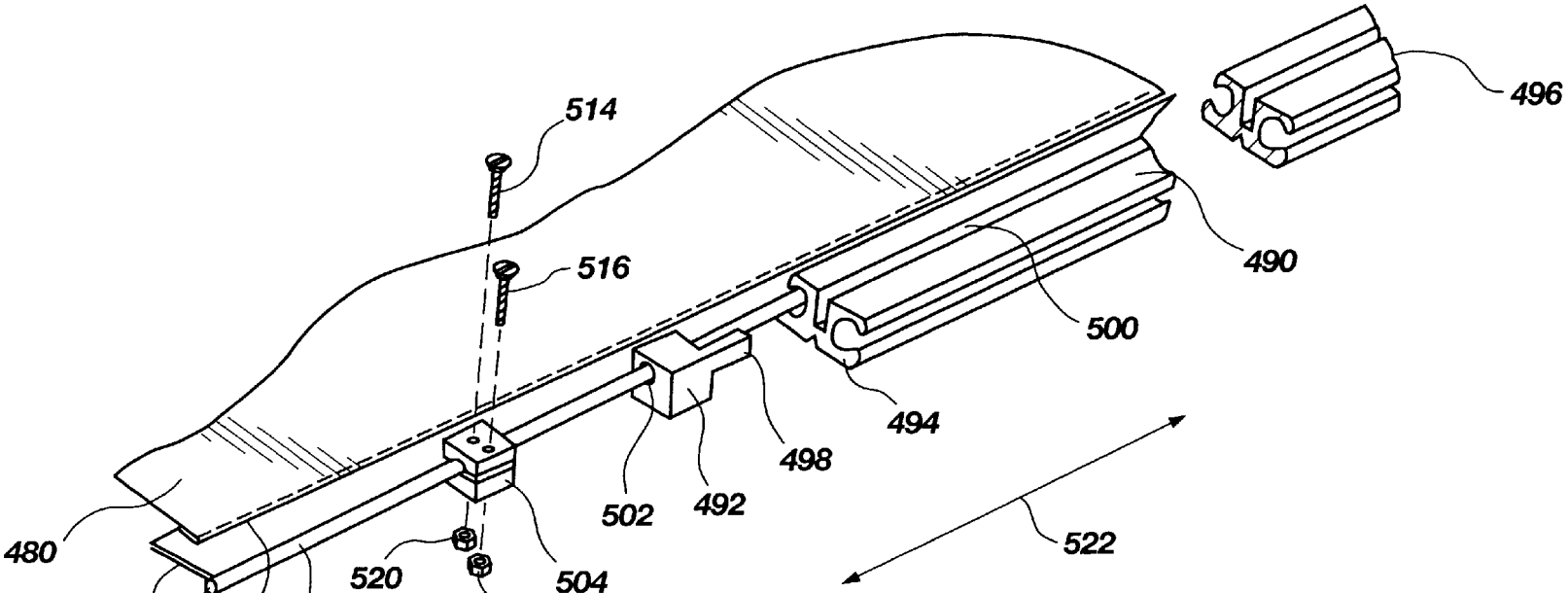
FIG. 15 is partial perspective view of the second end of a track with related components positioned in a spaced relationship.

Turning now to FIG. 15, a cover 480 is shown with an outside edge 482 having webbing 484 secured thereto by any acceptable means such as stitching. Of course the webbing may be secured by any means that will fixedly associate the webbing 484 to the cover 480 including gluing, annealing, stapling or the like. The webbing 484 has the inelastic rope 486 positioned to form a bead 488 as the outer edge 482 of the cover 480. The bead 488 is shown slidably engaged with track 490 which is here of the type that can fit under the lip of a pool. However, it should be understood that any form of track may be used both under a lip of a pool as well as for securement on the upper surface proximate the pool as hereinbefore discussed.

A fabric guide 492 is shown spaced away from the second end 494 of the track 490. The second end 494 of the track 490 is positioned toward the drum of the system which is not here shown but which is comparable to drum 26. The first end 496 is the end opposite the second end 494 and is the end to which a guide comparable to guide 22 is attached. A pulley such as pulley 74 (FIG. 2) is preferable as a guide.

The fabric guide 492 has a tongue 498 that extends away therefrom sized to frictionally insert into slot 500 formed in the track 490. The fabric guide 492 has a slot 502 formed in it to sidably receive the bead 488. The fabric guide 492 is made of a sacrificial material such as TEFLON®, nylon or the like. The track 490 is typically made out of non-corrosive material such as aluminum. When installed, the track 490 may have edges that are sharp and which in turn can damage the bead 488 and in turn the cover 480 over time. The fabric guide 492 erodes or wears while reducing the wear on the cover 480 and is replaceable as needed. It guides the bead 488 at the second end to reduce the wear and tear on the bead 488, the webbing 484 and the cover 480. Although the fabric guide 482 is shown connected to the track 490 by a frictional relationship between the tongue 498 and the slot 500, it may be understood that any mechanical arrangement to effect a non-moving relationship between the second end 494 and the fabric guide 492 may be used. Glueing, bolting and clamping are possible alternates.

Figure 16:
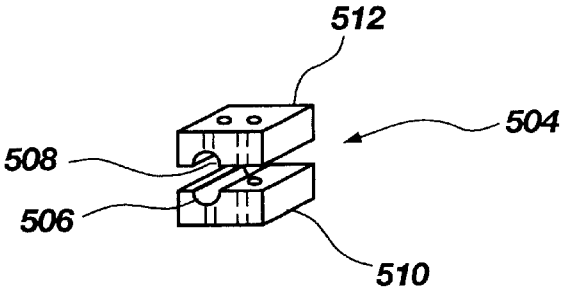
FIG. 16 is a perspective exploded view of a stop block for use with the present invention.

A stop block 504 is shown in both FIGS. 15 and 16. The stop block 504 is here shown with recesses 506 and 508 formed in each of the sections 510 and 512 respectively. The recesses 506 and 508 are sized to receive the bead 488 snuggly therein so that when the section 510 and section 512 are secured to each other such as by machine bolts 514 and 516 and corresponding nuts 518 and 520, the bead 488 is held securely therebetween in a non slidable or non-moving condition. It may be noted that the bolts 514 and 516 with their corresponding nuts 518 and 520 are intended to clamp the stop block 504 to the bead. Other arrangements may be used as a stop block. In the same vein, other means may be used to effect clamping of two members together including screws, rivets, friction snaps and the like.

In use, the stop block 504 is positioned along the length 522 of the bead 488 and edge 482 of the cover 480 so that the distance between the stop block 504 and the front edge of the cover 480 (similar to front edge 56 of cover 12 (FIG. 1)) is such that the stop block 504 reaches and contacts the fabric guide 492 or the second end 494 (if there is no fabric guide 492) so that the ropes attached to the front edge of the cover are tensioned by the associated rope reels. Thus the stop block 504 is secured to the bead 488 to contact the fabric guide 492 or the second end 494 before the cover 480 reaches the fully closed position. Any wrinkles or loose collections of fabric along the length of the track 490 are tensionally urged away to reduce frictional problems when the cover is to be operated back to an open condition. The cover is also regarded as having a better appearance. Further, use of the stop block 504 facilitates self alignment or automatic straightening of the cover like cover 480 as one edge of the cover approaches the closed condition before the other. That is, an edge such as edge 482 with its associated webbing 484 and bead 488, at the front edge of the cover, may reach or virtually reach the closed condition before the opposite edge. The stop block such as stop block 504 stops the edge 482 from further travel while the opposite edge continues to travel. Thus the cover may be said to be self aligning.

Reference herein to specific details of the embodiments disclosed is not intended to limit the scope of the claims which themselves recite those features which are regarded as essential to the invention.

What is claimed is:

1. A system for extending and retrieving a cover, said system comprising:

a cover shaped and sized for positioning over a space to be closed, said cover being moveable between a closed position substantially covering the space to be covered and an open position substantially removed from said space to be covered, said cover having a front edge, a first outside edge and a second outside edge spaced from said first outside edge;

first track means positioned proximate said space to be covered and configured to guide said first outside edge upon movement of said cover over said space to be covered, said first track means having a first end and a second end spaced from said first end;

second track means positioned proximate said space to be covered and spaced from said first track means, said first track means being configured to guide said second outside edge upon movement of said cover over said space to be covered, said second track means having a first end and a second end spaced from said first end;

first line means for urging said cover to move relative to said space to be covered, said first line means being formed of a substantially inelastic material and being connected to said cover at said front edge proximate said first outside edge to extend away therefrom;

second line means for urging said cover to move relative to said space to be covered, said second line means being formed of a substantially inelastic material and being connected to said cover at said front edge proximate said second outside edge to extend away therefrom;

first guide means positioned proximate said first end of said first track means to receive said first line means and to guide said first line means;

second guide means positioned proximate said first end of said second track means to receive said second line means and to guide said second line means;

a drum upon which said cover is wound and unwound, said drum having a first end and a second end and said drum being operable in a first direction to wind said cover thereupon and in a second direction to unwind said cover therefrom;

reel means positioned and configured for receiving said first line from said first guide and said second line from said second guide, said reel means being operable to tension said first line and said second line to urge said front of said cover over said space to be covered;

drive means for connection to said first end of said drum for supporting said first end and for rotating said drum in said first direction and for connection to said reel means for operating said reel means to tension said first line and said second line, said drive means including a reel housing for positioning proximate said drum, said reel housing being configured to support said reel means, a drive unit configured and connected to drive said drum in said first direction and to operate said reel means to tension said first line and said second line, and coupling means for drivingly connecting said drive unit alternately and selectively to said reel means for operating said reel means and to said drum to rotate said drum in said first direction;

a first stop block secured to said first outside edge to abut said second end of said first track means with said cover proximate said closed position and said front edge of said cover in tension;

a second stop block secured to said second outside edge to abut said second end of said second track means with said cover proximate said closed position and said front edge of said cover in tension; and support means for connection to said second end of said drum for supporting said second end of said drum.

2. The system of claim 1 wherein said first outside edge has a length and includes a first webbing extending substantially along said length with a first distal edge oriented and configured for association with said first track means.

3. The system of claim 2 wherein said second outside edge has a length and includes a second webbing extending substantially along said length with a second distal edge oriented and configured for association with said second track means.

4. The system of claim 3 wherein first line means is a first rope, wherein said first webbing has a first channel formed along said first distal edge, and wherein said first distal edge is a bead formed from said first rope positioned within said first channel.

5. The system of claim 4 wherein second line means is a second rope, wherein said second webbing has a second channel formed along said second distal edge, and wherein said second distal edge is a bead formed from said second rope positioned within said second channel.

6. The system of claim 5 wherein said first stop block is secured about said first bead.

7. The system of claim 6 wherein said second stop block is secured about said second bead.

8. The system of claim 7 wherein said first stop block has an upper portion and a lower portion for securement to each other with said first bead thereinbetween.

9. The system of claim 8 wherein said second stop block has an upper portion and a lower portion for securement to each other with said second bead thereinbetween.

10. The system of claim 9 wherein said first track means includes a first track having a bead channel formed therein sized to slideably receive said first bead and a fabric guide for positioning proximate said second end of said first track means.

11. The system of claim 10 wherein said second track means includes a second track having a bead channel formed therein sized to slideably receive said second bead and a fabric guide for positioning proximate said second end of said second track means.

12. The system of claim 11 wherein said first line means is a non-metallic rope.

13. The system of claim 12 wherein said non-metallic rope is of the type that has less than about ten percent stretch upon application of a tensioning force of up to about 500 pounds.

14. The system of claim 12 wherein said non-metallic rope is of the type that has less than about five percent stretch upon application of a tensioning force of up to about 500 pounds.

15. The system of claim 12 wherein said non-metallic rope is of the type that has less than about two percent stretch upon application of a tensioning force of up to about 500 pounds.

* * * * *